US005394631A

United States Patent [19]

Bosio

[11] Patent Number: 5,394,631

[45] Date of Patent: Mar. 7, 1995

[54] MULTIPLE-PANEL ADVERTISING SIGN-CAPABLE OF ASSEMBLING MULTIPLE MESSAGES WHICH ARE SELECTED AND DISPLAYED INDIVIDUALLY

[76] Inventor: Carlos C. Bosio, José Hernández 543 (1641) Acassuso, Pcia. de Buenos Aires, Argentina

[21] Appl. No.: 927,844

[22] Filed: Aug. 11, 1992

[30] Foreign Application Priority Data

Jul. 8, 1992 [AR] Argentina ..... 322.706

[51] Int. Cl.[6] ..... G09F 11/00

[52] U.S. Cl. ..... 40/491; 40/492; 160/206

[58] Field of Search ..... 40/491, 492, 508, 509; 160/196.1, 199, 206

[56] References Cited

U.S. PATENT DOCUMENTS

| | | | |
|---|---|---|---|
| 1,943,629 | 1/1934 | Schwartz | 40/492 X |
| 2,976,923 | 3/1961 | Hirashiki | 160/199 X |
| 3,411,561 | 11/1968 | Mock | 160/199 X |
| 3,419,063 | 12/1968 | Mock et al. | 160/199 |
| 3,984,930 | 10/1976 | Booland | 40/491 |

FOREIGN PATENT DOCUMENTS

| | | | |
|---|---|---|---|
| 308041 | 1/1969 | Sweden | 40/491 |

*Primary Examiner*—Brian K. Green

*Attorney, Agent, or Firm*—Marks & Murase; Michael D. Bednarek

[57] ABSTRACT

A multiple-panel display device for assembling and displaying selected messages includes at least one pair of rigid rectangular panels each having a display surface for displaying a message, a first articulation connecting the panels in each pair to one another, and a supporting frame with a guide for guiding the panels between a first position in which their display surfaces are in the same plane, and a second position in which their display surfaces are mutually confronted. The display device includes a plurality of sheets having images formed thereon which are angularly displaceable with respect to the panels, and a fastening system on each panel for selectively fastening a selected number of the sheets against the display surface of each of the panels. The display device may include several pairs of display panels and corresponding sheet assemblies operating in a predetermined sequence.

16 Claims, 11 Drawing Sheets

MULTIPLE-PANEL ADVERTISING SIGN-CAPABLE OF ASSEMBLING MULTIPLE MESSAGES WHICH ARE SELECTED AND DISPLAYED INDIVIDUALLY

BACKGROUND OF THE INVENTION

1. Field of the Invention

The present invention relates generally to multiple-panel display devices. In particular, the present invention relates to advertising signs capable of assembling multiple messages which are selected and displayed individually. The advertising sign of the present invention is capable of composing more than one message by the movement of one or more parts following a programmable sequence.

2. Description of the Prior Art

Signs which provide variable advertising images already exist. These signs are made up of long equilateral-triangular sections that turn around a longitudinal axis. The images are contained on the distinct portions on each visible face of the triangles, set next to each other so that the appearance to the observer changes as the triangles rotate. The advantage of these signs is that three different images can be obtained with a single supporting frame and a set of triangular elements. This allows for low structure costs, while offering an attractive, rotating advertising image. The most common applications are those found in stadiums, public places and other areas where the size of the audience makes the installation cost-effective.

However, these signs have three major limitations. The first is the size of the structure. Each triangular element is supported only at its two extremes. If the length of an element is excessive, the weight of the element may disturb its rotation and prevent the device from functioning properly. The second limitation is that the sign may only present three different messages. The final major limitation is that whenever there is a need to change the three advertising messages, all the triangular elements must be replaced. They must be returned to the laboratory; and then, with the care that a segmented device requires, the new images have to be repainted or attached to the faces of the triangular elements. This process implies very high costs for changing the advertising messages.

These limitations are the reasons why there is usually a preference for a system with a base structure and a support frame on which a single advertising message is posted. However, on these signs the only ways to change the message are to repaint the sign board or to replace the advertising sheet. This means that these signs, because they are fixed, do not allow the displayed message to change in a programmable way.

There is a clear need for a new device with all the virtues of a large variable-image sign, but without the consecutive discontinuities and the limited variety of composed images provided by the triangular elements.

SUMMARY OF THE INVENTION

It is an object of the present invention to provide a device for displaying advertising images in a wide variety of sizes, from a few square meters to the size of large public advertising signs.

It is a further object of the present invention to provide a sign which contains a large number of composed images. For example, to twenty-five distinct images can be assembled from the same sign.

It is a further object of the present invention to provide a faster, simpler, and less costly system of changing the composed images of a sign.

It is a further object of this invention to provide informative signs which can be used to announce spectacles, events, expositions, and display other kinds of information.

It is a further object of this invention to provide an advertising sign in which there is never a blank image. Even when the formations of the composed images are changing, an image is presented to the viewer.

It is a further object of the present invention to provide, in one particular realization, a sign made up of only one formation, with no complete frame.

It is a further objective of the present invention to provide a sign which is versatile with regard to sequence and timing of the displayed images. For example, images in a sequence can be skipped, the exposition time can be adjusted for each image individually, and there can be different schedules for particular groups of images.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects, and in accordance with the purpose of the present invention, as embodied and broadly described herein, the device of this invention may comprise a multiple-panel display device for assembling and displaying selected messages, comprising a first pair of generally rectangular panels, each panel having a display surface for displaying a message; a first articulation connecting said first pair of panels to each other; a supporting frame with a guide means for guiding said first pair of panels between a first position in which said display surfaces of said first pair of panels are generally coplanar, and a second position in which said display surfaces are mutually confronted; wherein a plurality of sheets having images formed thereon are linked to said first articulation and are angularly displaceable with respect to said panels about said first articulation, and fastening means on each panel for selectively fastening a selected number of said plurality of sheets against the display surface of a respective one of said panels, whereby the image formed on at least one selected sheet forms a portion of a displayed message when said first pair of panels are in their first position.

In accordance with another aspect of the present invention, the display device may comprise a structure capable of supporting multiple rigid rectangular panels, with at least one surface and at least one portion of an image which assembled in the same plane is able to display an advertising message, including a supporting frame with a guide device which define at least one circuit; this sign is made up of at least one pair of panels located next to each other and linked by parallel articulations; the first pair of panels is connected by means of the common borders, defining a first type articulation and the parallel border of one of the panels is, in turn, linked to the following couple by means of the common border defining a second type articulation; the succession of panels so articulated has a first position in which the panels are in the same plane defining an image, and a second position in which the panels are mutually confronted; from at least one of the borders of at least one of the panels there exist moveable linking elements to the guide device; at least one of the first or second articulations describes a path with components which are perpendicular to the guide device, while at least some of the remaining articulations' paths are parallel to the same guide device; the panels are linked to the structure by the linking elements to the guide device, and at least one articulation chosen between an articulation linked to one of the extreme borders of the set of panels, or at least one of the first or at least one of the second articulations; multiple sheets are linked individually to each first articulation and are disposed between the surfaces of the couple of panels corresponding to this articulation; the sheets are angularly displaceable in an individual basis from one panel to the other conforming at least one set of sheets one over the other held selectively together on each panel; the last sheet of each set presents on the visible face the advertising message or the corresponding portion of the advertising message; each panel has its support and fastening means for each sheet; being this support and fastening means, acting over, at least, the last sheet, pressing the rest between the last sheet and the surface of the panel.

Based on the mechanism described above, many different signs can be formed. But with the goal of demonstrating the previously mentioned advantages, and to facilitate the understanding of the constructive and functional characteristics of the Multiple-Panel Advertising Sign of moving panels, capable of assembling multiple messages which are displayed and selected individually, selective examples will be described on the following pages. Given the fact that they are only examples, they should not lead to limitations in the protection scope of the current patent of invention, but rather, they should serve as a tool to understand it.

BRIEF DESCRIPTION OF THE DRAWINGS

The accompanying drawings, which are incorporated in, and form part of, the specification, illustrate an embodiment of the present invention and, together with the description, to explain the principles of the invention. In the drawings.

DETAILED DESCRIPTION OF THE PREFERRED EMBODIMENT

Based on the previously described figures, the preferred embodiment of the invention will now be described in detail.

Figure 1:
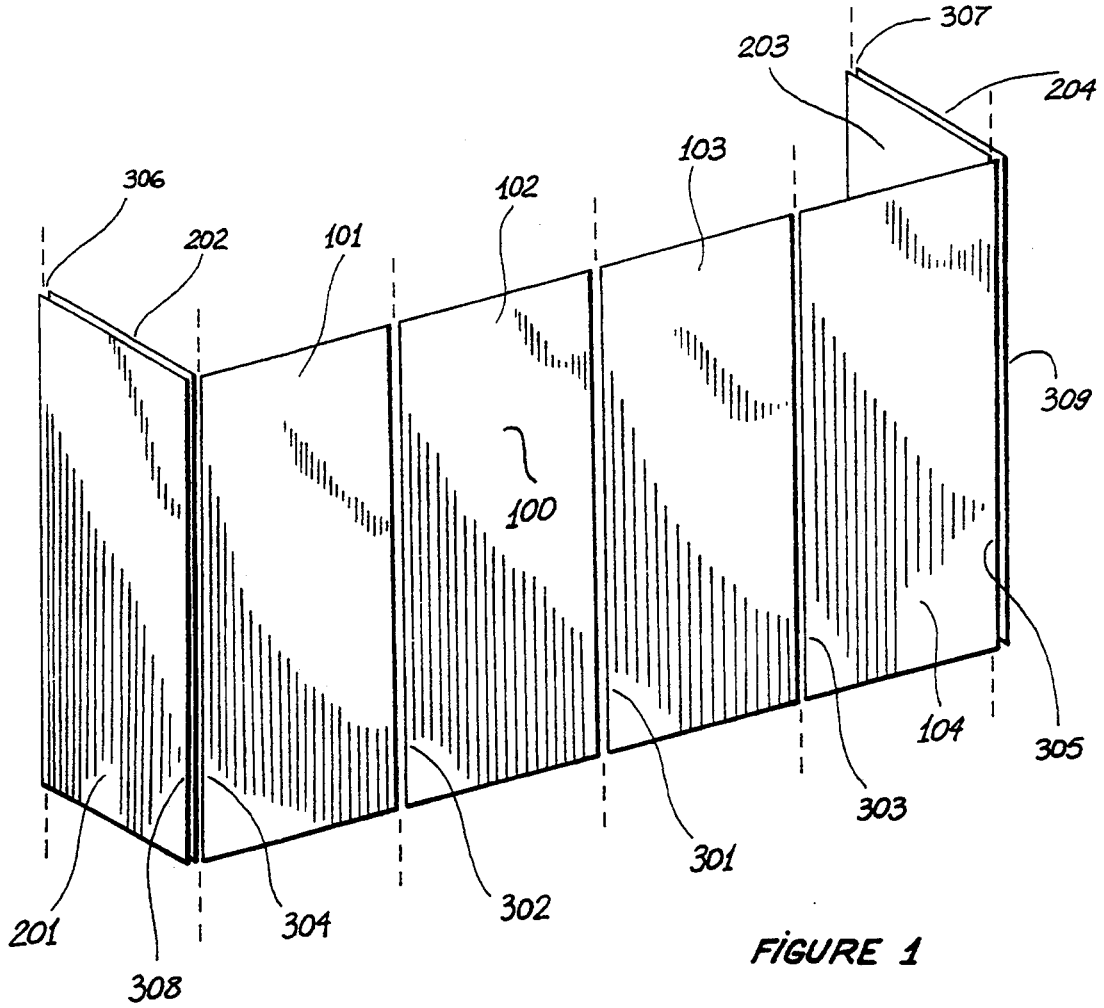
FIG. 1 is a perspective view of an advertising sign according to the present invention showing the general layout of the advertising panels in a "first position".

FIG. 1 shows the general layout of the advertising panels of the present invention in their first position. This figure shows the surface 100 carrying the advertising sign put together as if it were a regular sign. This surface 100 is composed of four panels (101, 102, 103, 104) that define a first formation, in which these four panels are in the same plane. The other four panels (201, 202, 203,204), which define a second formation, are not visible to the viewer because they are hidden behind a frame's lateral sides (not shown in the figure).

In the illustration, a first articulation (301) in the central position joins panels (102) and (103). This articulation maintains a fixed position with respect to the carrying frame (not shown in the figure). Panels (101) and (102) are linked by a second articulation (302). Similarly, a third articulation (303) links panels (103) and (104).

The outermost panels of the first formation (101 and 104) are linked with the panels of the second formation (202 and 203) by fourth and fifth articulations (304) and (305), respectively.

The second formation is made up of two pairs of panels, one pair on each lateral side of the sign. The left pair (201 and 202), are linked by a sixth articulation (306), and the right pair (203 and 204) by a seventh articulation (307). The pair of panels (201, 202) are linked to the first formation by means of the fourth articulation (304), and the pair of panels (203, 204) to the first formation by means of the fifth articulation (305). Finally, panels (201) and (204) are fixed to the left and right lateral sides of the structure by means of eight and ninth articulations (308 and 309). These two articulations are joined to the extreme borders of these panels and maintain fixed positions.

Figure 2:
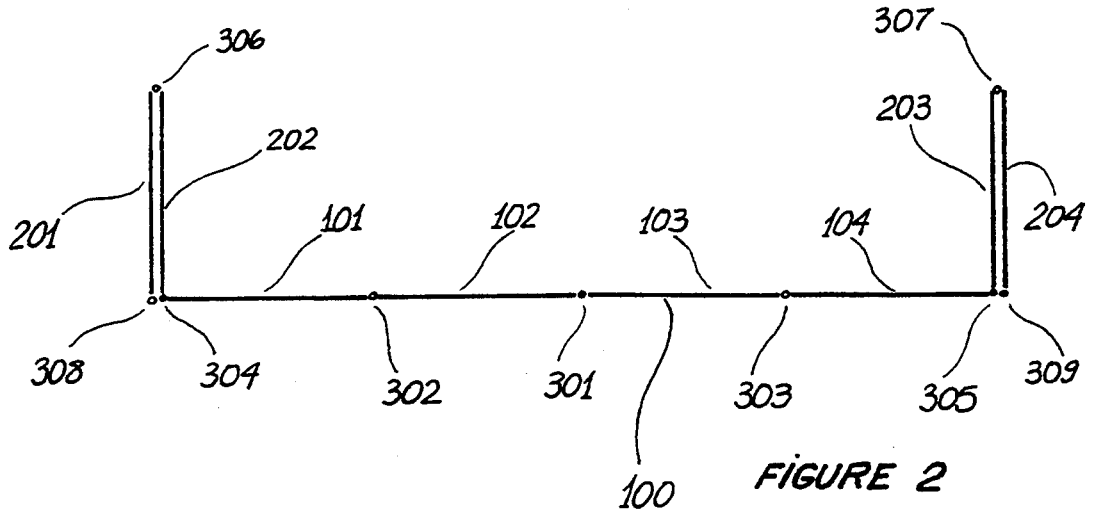
FIG. 2 is a plan view showing the advertising panels in the same arrangement as in FIG. 1.

FIG. 2 shows a plan view of the same position described in FIG. 1. The sign is kept in this position for a designated length of time. At the end of this period, the panels of the first formation (101-102-103-104) start to fold, leaving their positions in the frontal plane (see FIG. 3). The fourth and fifth articulations (304 and 305) move across the plane defined by their original positions towards the center of the sign, while the second and third articulations (302) and (303) leave the frontal plane by moving backwards.

Figure 3:
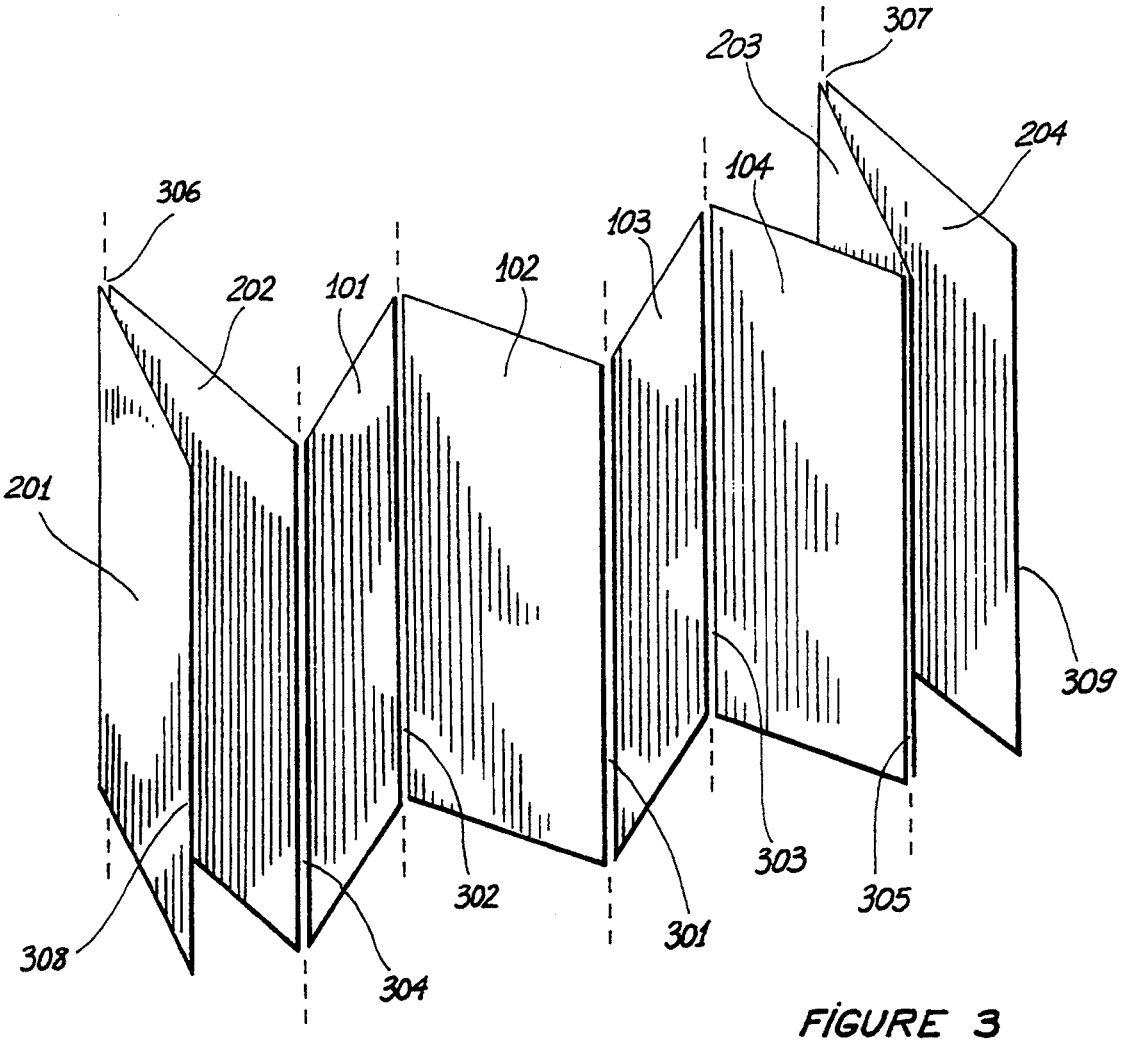
FIG. 3 is a perspective view of the sign in an intermediate movement state.
Figure 4:
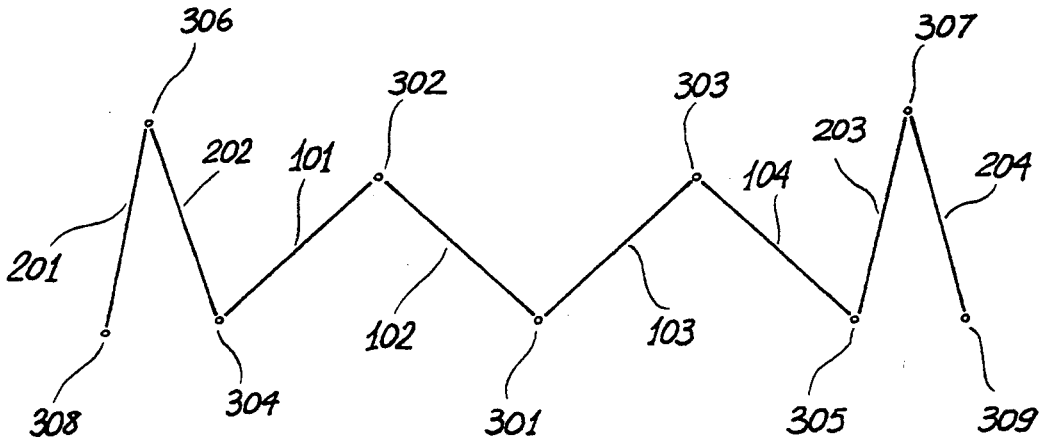
FIG. 4 is a plan view showing the advertising panels in the intermediate state shown in a FIG. 3.

FIG. 3 shows an intermediate state of the movement described above. In FIG. 3, panels of the second formation are entering the view of the observer. They are carried by fourth and fifth articulations (304) and (305). The sixth and seventh articulations (306) and (307) can also be seen in this figure. This particular moment in the movement of the sign can also be seen in the plan view of FIG. 4.

Figure 5:
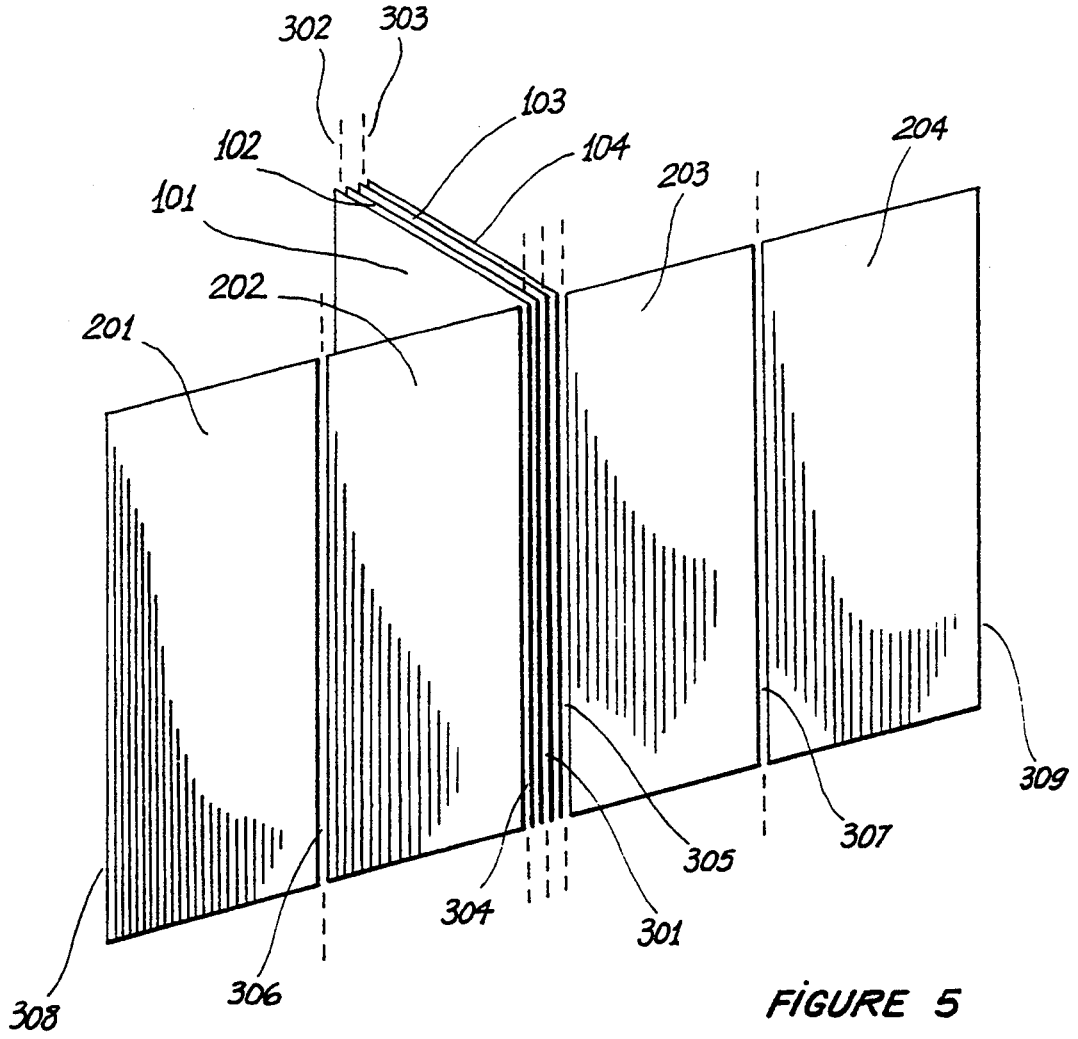
FIG. 5 shows another perspective view of the sign showing the general layout of the panels in a "second position".

The movement continues with displacement of the articulations (304) and (305) and ends when they reach the central position together with joint (301). This position, called the second position, is shown in FIG. 5. The sign is in a static position again, showing a new surface to the viewer. This surface remains fixed, but is made up of the consecutive panels of the second formation (201, 202, 203, 204) in the same plane, which means that a new and different advertising message is shown.

Figure 6:
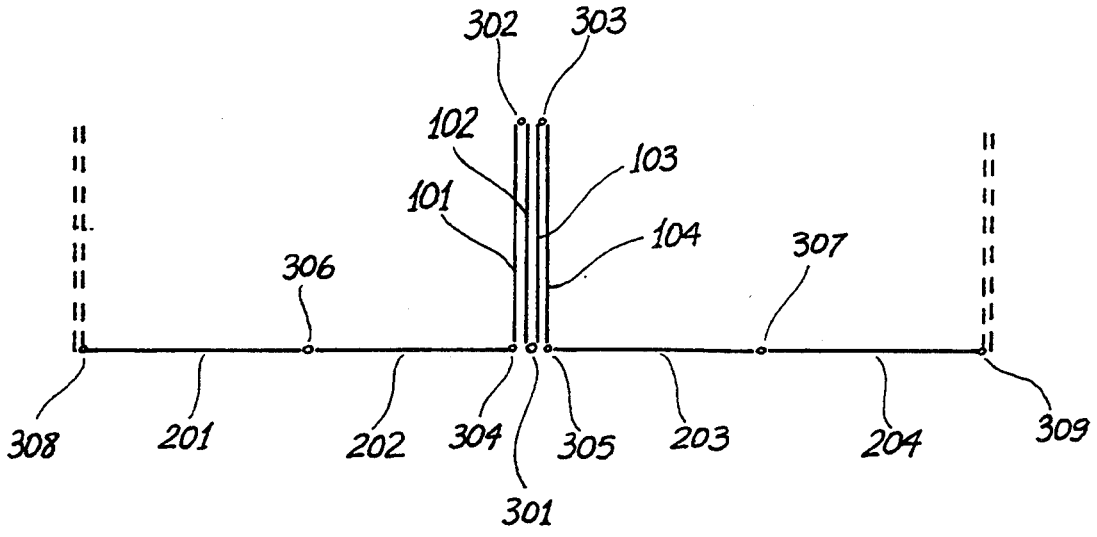
FIG. 6 is a plan view showing the advertising panels in the second position shown in FIG. 5.

FIG. 6 shows a plan view of the panels in the second position.

The first position shown in FIG. 1, and the second position shown in FIG. 5, constitute the two extreme stages of the sign movement. In the first position, only the message of the first formation of panels is visible. In the second position, only the message of the second formation of panels is visible. Of course, each formation displays a different message. The sign changes from one extreme stage to the other, and then back to the first one, and so on, through the translation movement shown in FIG. 3.

As will become apparent, articulations 302, 303, 306 and 307 are of a first type of articulation (hereinafter "first type articulations") which is different than articulations 301, 304, and 305, which are of a second type of articulation (hereinafter "second type articulations").

Based on the above description, the following features of the present invention will become apparent:

i—The minimal unit necessary to form a sign is composed of one pair of panels joined by a first articulation.

ii—The inclusion of more panels is done by connecting minimal units together. Signs of four, six, or eight panels can be made with the present invention. The number of panels will always be an even number, and there will always be as many first type articulations (e.g., 302, 303, 306 and 307) as minimal units in the sign.

iii—Since the sign is made up of a repetition of minimal units, the number of second type articulations (e.g., 301, 304 and 305) will be one less than the number of minimal units. So, if the sign is formed by just one pair of panels (i.e., one minimal unit), there will not be any second type articulations.

iv—The linkage of a succession of panels to the structure is made by means of the guide device. Also, the panels are linked to the structure by the articulations at the extremes (in the figures, 308 and 309) or by at least one of the first or second type articulations.

v—A succession of panels might be organized in a way such that it will be formed by two or more independent formations. The formations will be shown separately. When the first formations are shown, the sign will be in its first position, in which the rest of the formations are hidden. When the second formation is shown, the sign will be in the second position, with the panels of the first formation hidden. There will be as many different positions as there are panel formations.

vi—Some parts of the sign move as the displayed image is changed. The changing of images involves the movement of articulations at the extreme borders or of the first or second type articulations in the formation being displayed currently. The movement of the articulations may be in a variety of directions (toward the center or the sides, forward or backward, straight or curved, etc). When the motion is completed, the minimal units of the formations not being displayed will be mutually confronted.

vii—The movement of each panel will be a combination of rotation and translation motions.

viii—While one of the formations is being taken out in this way, another is entering the visual scope of the viewer. If there is only one formation of panels, it will fold into a thin discontinuity. This translation movement may be done in a horizontal, vertical, or oblique direction, according to the format and the needs of the particular sign.

Figure 7:
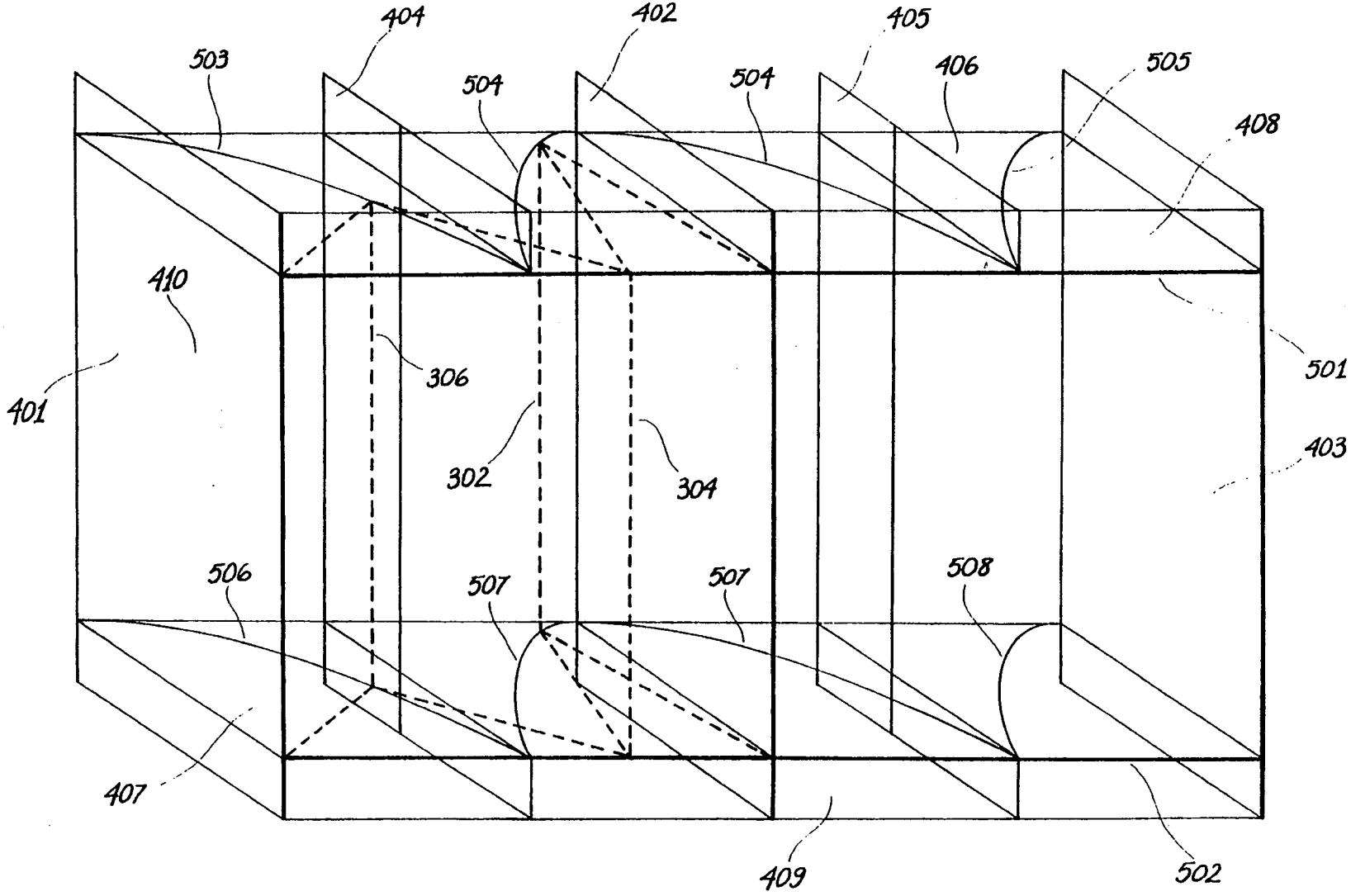
FIG. 7 is a perspective view that illustrates the organization of the structure supporting the panels of the present invention.

FIG. 7 shows a preferred embodiment of one type of supporting structure of the sign. In FIG. 7, a number of structural elements can be seen which are called "rigid planes". They are:

Main rigid planes (401, 402 and 403), which are two vertical planes on the extremes and one on the center of the structure;

Two vertical rigid planes (404 and 405) located between the extreme and the central rigid plane;

Two horizontal rigid planes, one upper and one lower (406 and 407);

Two longitudinal beams, one upper (408) and one lower (409). These beams rest against the main rigid planes (401, 402 and 403); and One vertical rigid plane posterior (410) which rests against the main rigid planes (401, 402 and 403).

The guide features, on which the first and second articulations move, can also be seen in FIG. 7. In this particular illustration, the guide features (501 and 502) are straight and are attached to the longitudinal beams (408 and 409, respectively). These are simple rods over which the second type articulations (301, 304 and 305) move. There are also curved guides (503, 504, 505, 506, 507 and 508), which are curved rods laying on the horizontal rigid planes (406 and 407).

This supporting structure is one example of many of how the sign's panels might be supported. Each plane (406 and 407) has a defined network of guide features. They may not be necessary in small and medium size signs, where the panels do not need the superior curve rods. In the same way, the C planes can be eliminated for small dimension signs. Rigid planes may be replaced by other elements that serve the same purpose (e.g., a reticulated plane).

Figure 8:
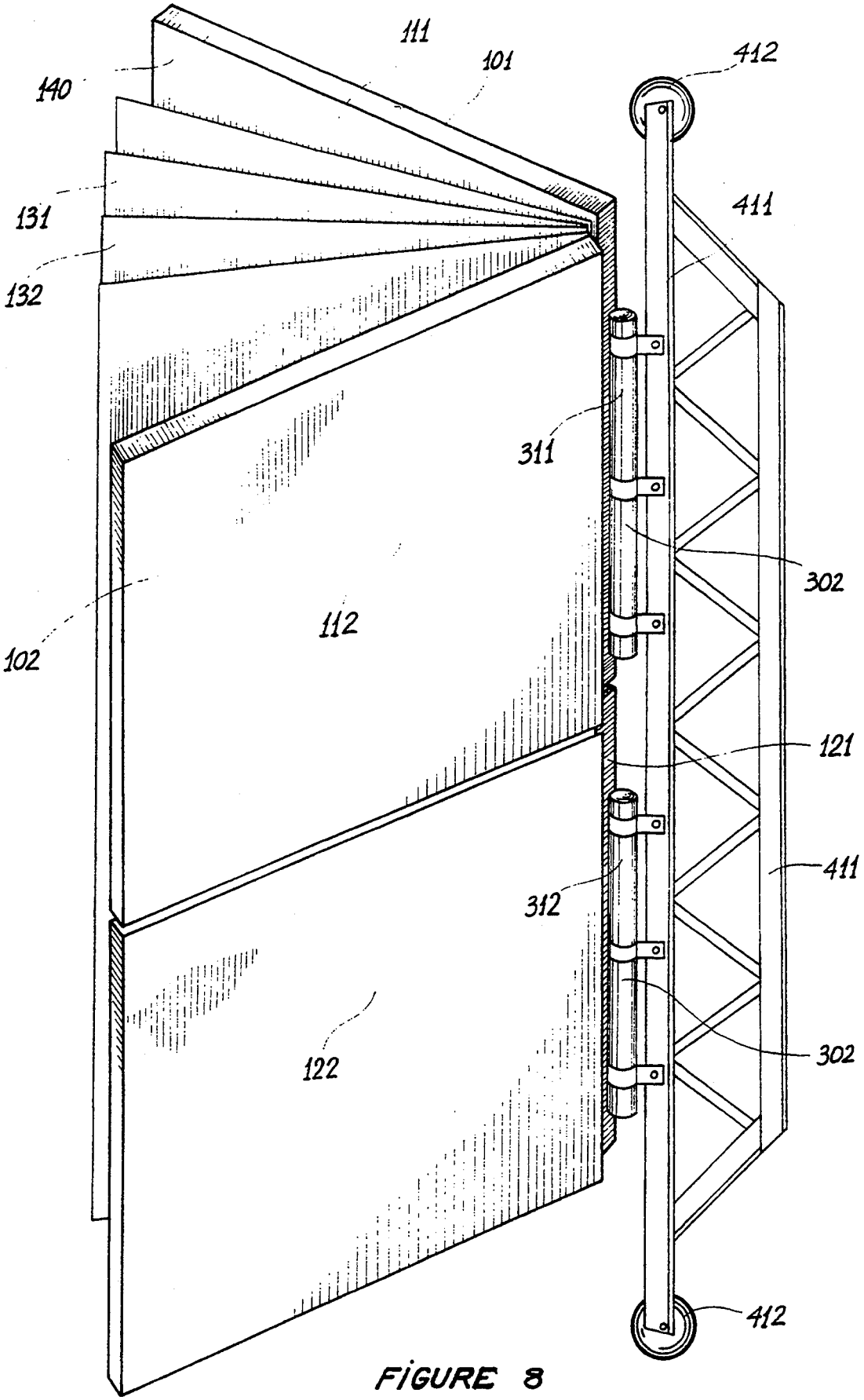
FIG. 8 is a perspective view of a first type articulation which links two panels and sets of advertising sheets between the two panels.

FIG. 8 illustrates a first type articulation corresponding to (302) of FIG. 1. This first type articulation is linking panels (101) and (102). The articulation is a "piano type" hinge that links the pair of panels. The hinge might not cover the total length of the borders of the two panels and does not even need to be one continuous joint.

In this large-size version of the sign, the panels forming the exposed area might be divided into two independent sub-panels. Panel (101) is divided into half-panels (111-121), and panel (102) is divided into half-panels (112-122), which both have their own "piano-type" hinge (311) and (312), respectively. In the large-area signs, the first type articulations are also supporting devices, important to counteract the force of the wind. For that purpose, articulation (302) is linked to a wind resistant beam (411), which might have reticulated or filled area and will be part of the structure.

In the smaller area signs, the first type articulations will only be composed of a single hinge that will link both panels. This articulation will be formed by joining hinges (311) and (312).

The movement that allows the sign to change from one position to another is described by a quarter-circle-circuit of the first type articulations (302, 303, 306, and 307). The wind-resistant beam would be laid above this circuit. For that purpose, the curve rods (503 to 508) shown in FIG. 7 will be needed as guide and support aids.

Beam (411) has a rolling system (412) that will allow it to move on the curved rods.

For small signs, the first type articulations complete the circuit without any guide nor any support. The weight and the effect of the wind can be absorbed by the second type articulations (301, 304 and 305), which flank the first type articulations (302, 303, 306 and 307). This means that it will not be necessary to use curved rods nor wind-resistant beams (411).

Between panels (101) and (102), which are linked by articulation (302), are a number of sheets. Among them, (131) and (132) have been identified in FIG. 8. These sheets are attached to the articulation they converge into, in this case articulation (302).

Figure 11:
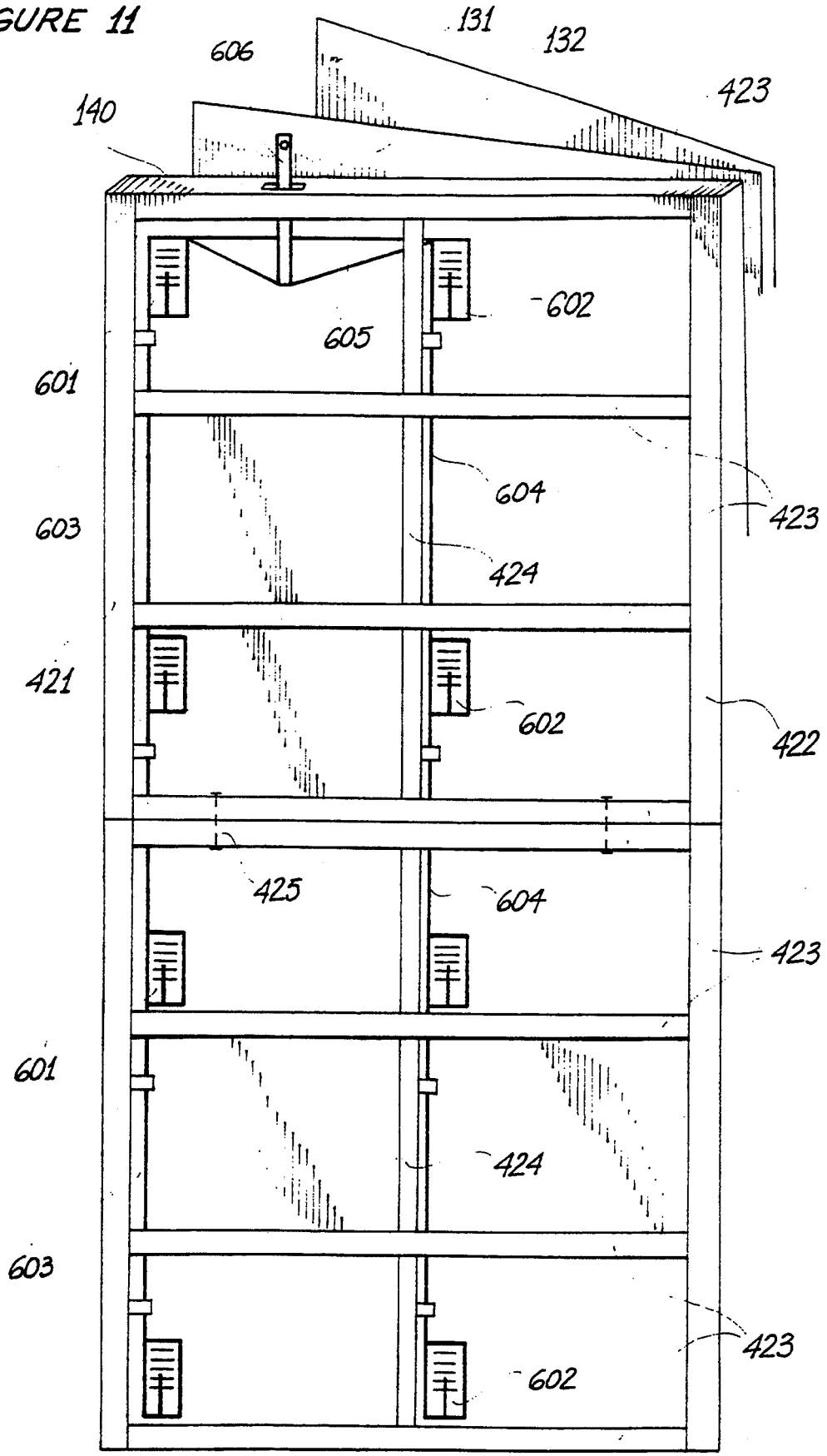
FIG. 11 is a perspective view of the back of a panel and the support structure.

All the panels in this particular example of the sign have a frame made of tubular rectangular (cross-section) supports like the one shown in FIG. 11. A metal (or other material) sheet is attached to this frame, defining surface (140) of the panel (101). Sheets (131) and (132) are made of the same material as that used in the surface of the panels. Sheets (131) and (132) do not have any frame, which means they are very thin.

The number of sheets may vary from one to twenty or even more. The sheets are gathered into two groups (sets of sheets), one with each of the panels, when these panels are in the same plane. The sheets are all attached to the first type articulation which joins the pair of panels in each minimal unit. The first sheet of each set has angular movement independently of the others.

Figure 9:
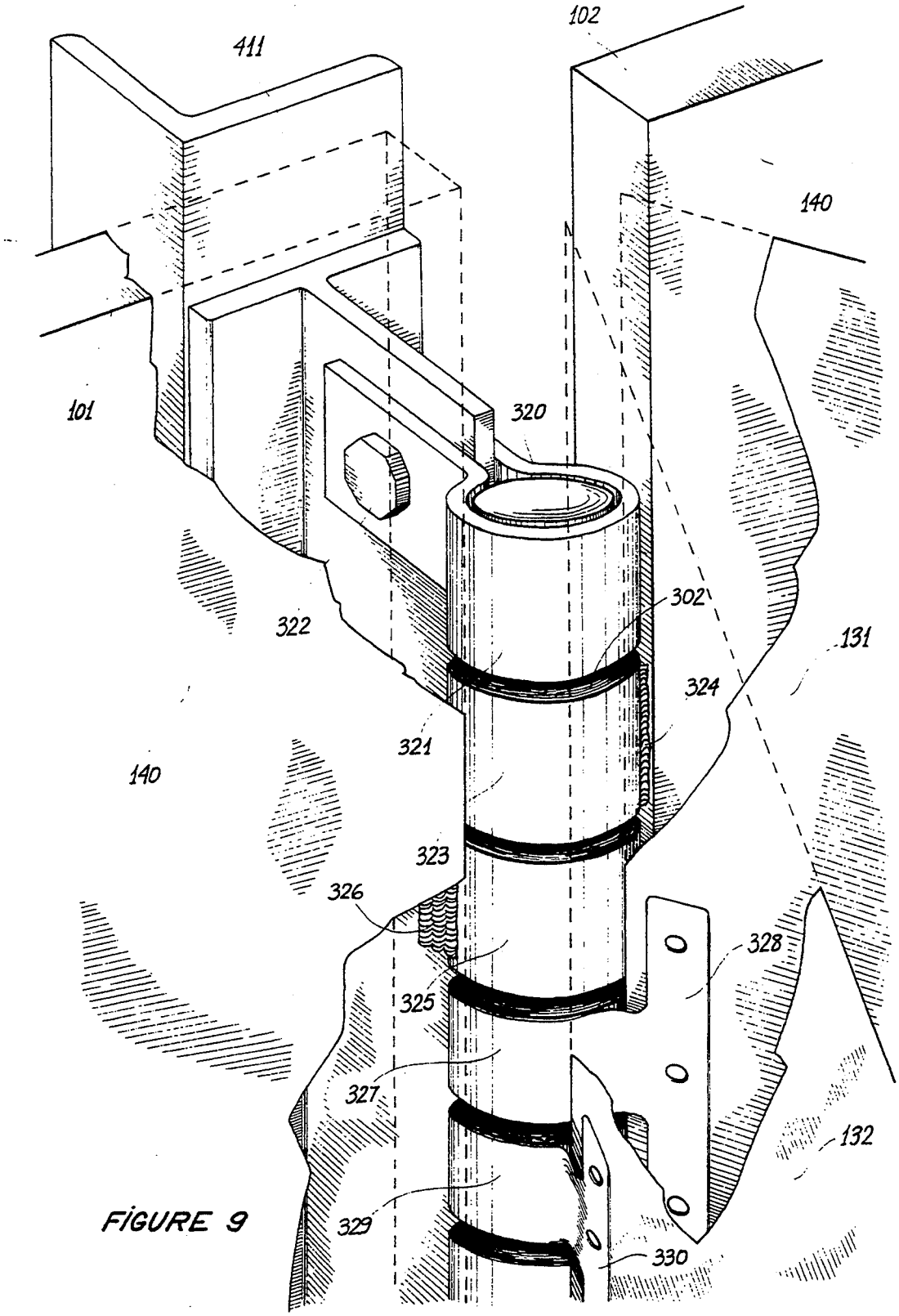
FIG. 9 is a detail perspective view of the first type articulation shown in FIG. 8.

FIG. 9 shows a detailed view of hinge (302) in a position that puts its associated panels (101 and 102) in the same plane. This position is the first position for articulation (302) (FIG. 1). Sheets (131) and (132), which are linked to this articulation, do not lie on the panel in the figure (which is how they would normally appear). Rather, they are angularly displaced and opened in order to show a more clear view of the position.

The hinge is composed of a stem (320), which is the articulation axis. A group of rings (a series) rotates around the stem. These series of rings are repeated a number of times along the axis. These rings link the different objects to the first type articulation (302). The following is an analysis of the series of rings shown in FIG. 9:

Ring (321) attaches the wind resistant beam (411) and links the stem to the beam using a male screw (322). This ring has a clasp form and partially surrounds the stem. Two small wings extend from the ring and are used to fasten the beam (411) and the stem by means of the previously mentioned screw.

Ring (323) links panel (102) to the articulation. The ring may be soldered to the panel by means of a soldering cord (324).

Ring (325) links panel (101) to the same articulation by means of solder (326).

Ring (327) fastens one of the sheets (131) of the set to the same articulation. In this case, the ring has a clasp (328) which is riveted to the sheet (131) and supports the sheet.

Ring (329) fastens the other sheet (132) to the articulation by means of its clasp (330).

There will be as many rings of type (327) or (329) within each series, as the number of sheets. This is because one of them will be needed for each sheet linked to the articulation.

Figure 10:
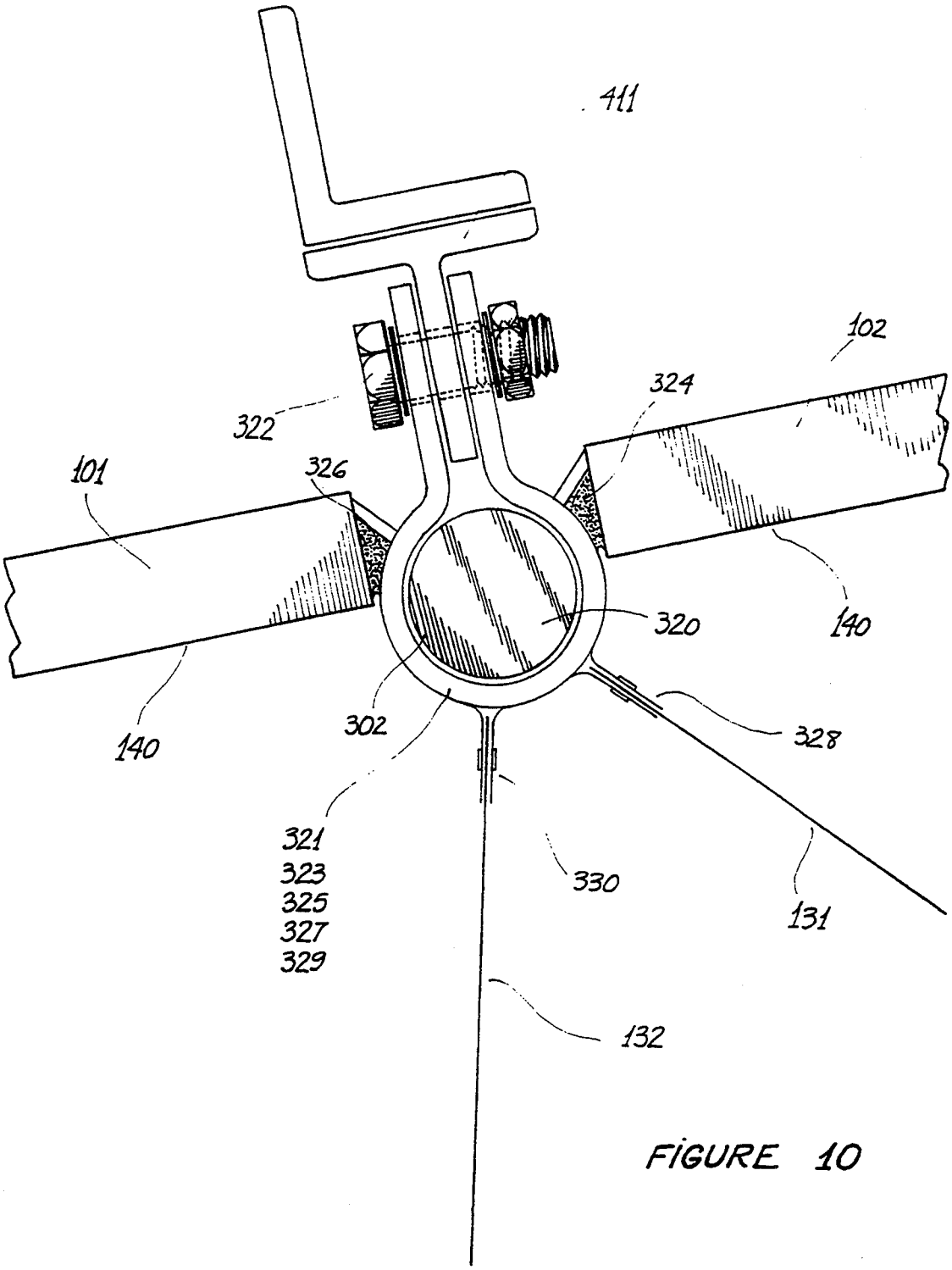
FIG. 10 is a plan view of the same articulation as in FIG. 9.

FIG. 10 shows a plan view of FIG. 9, with the rings (321, 323, 325, 327 and 329) one over the other.

FIG. 11 shows the reverse side of a panel, illustrating the basic structure. Attached over this structure is a metal (or other material) sheet (140). In this large dimension version of the sign, each panel is at least two meters wide by four meters high, which implies a difficult message-replacing process. For this reason, panels of this size are usually divided into smaller panels.

This frame is made up of the following elements:

Two tubular rectangular supports (421 and 422), vertically positioned on the sides. These supports will not be continuous if the large panels are divided into smaller ones.

Seven transverse horizontal supports (423) soldered to the vertical supports. At the verticle midpoint, two supports may be next to each other because one would belong to the superior sub-panel and the other to the inferior one. These two supports are attached by means of screws (425) in order to eliminate relative movements between the two parts of the panels.

Intermediate vertical supports (424), in between the transverse supports, that form a vertical line.

In FIG. 11, the support and fastening means for the sheets can also be seen. In this case, it is represented by a series of locks with bolts organized in two vertical lines. One series of locks (601) is close to the border of the panel, and the other series of locks (602) is in the central line. Each series of locks are linked by the respective vertical rods (603 and 604).

The vertical rods are held to the panel's vertical supports by guides. The rods are linked to each other at their superior extremes by means of a "hanger" (605). This hanger allows the vertical displacement of the whole lock system, whose movement is initiated by an attached bar (606).

Figure 12:
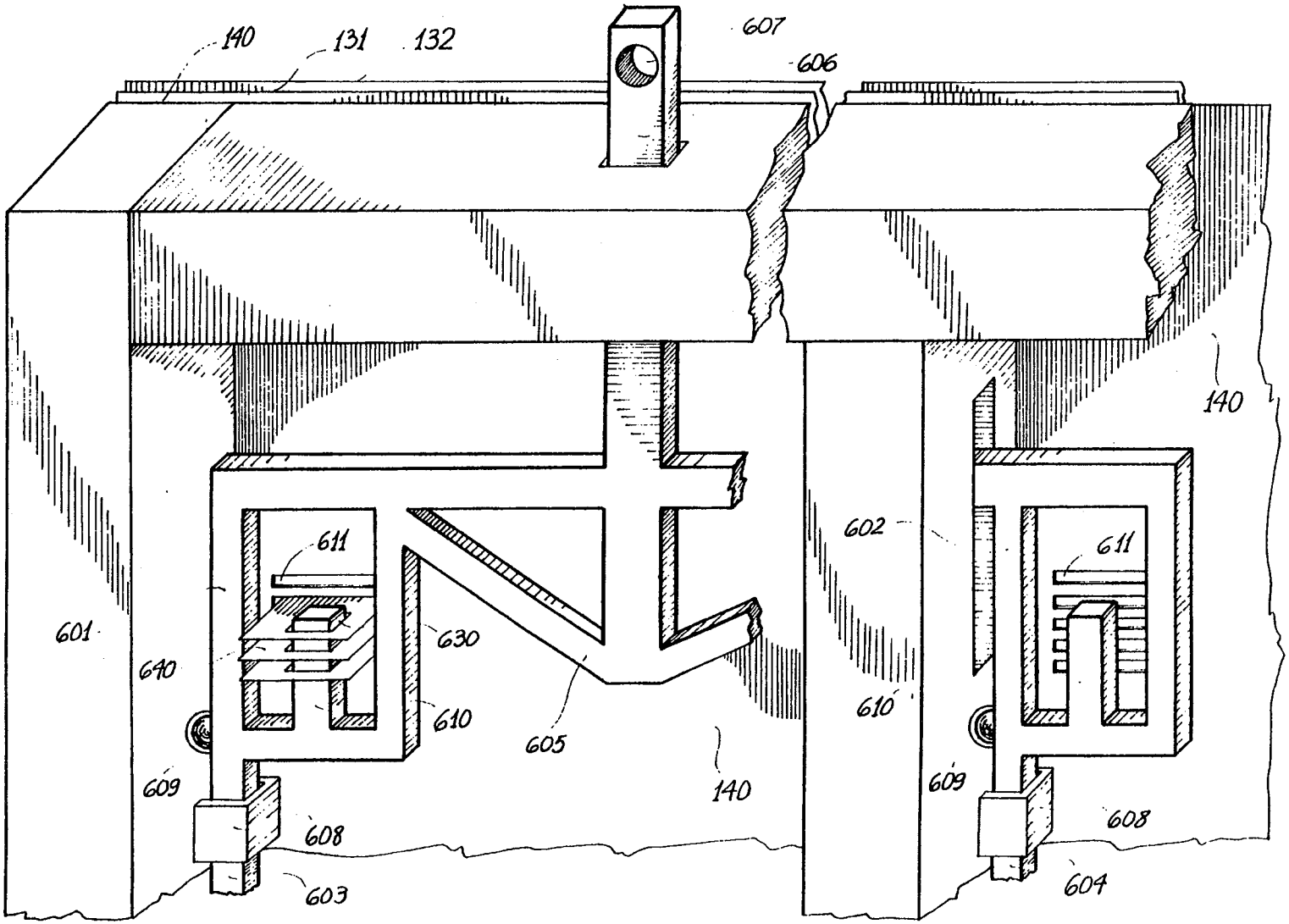
FIG. 12 an enlarged perspective view of the support structure shown in FIG. 11.

FIG. 12 shows a detailed version of FIG. 11. Two locks with their respective bolts can be seen; the first of the series (601) and the first of the series (602).

Each lock of this type consists of a rectangular frame, made up of small rods, and a bolt (610) attached to the top or bottom of the frame. The bolt is attached to the top or the bottom depending on whether the lock is in the left panel or the right panel. All the bolts in one of the pairs (left or right) of panels are attached in the same way. For example, all the bolts may be attached to the lower rod of the lock's frame. For this reason, they are called inferior bolts. All the rods of the other panel of the pair, in the same way, are attached to the lock's frame upper rod, and are called superior bolts. The reason for this will be explained later.

One of the lateral sides (601) of the lock's frame, is part of the rod (603) that vertically joins all the locks of the line. The same thing applies for lock (602) and rod (604). The guides (608), which hold the rods against the lateral supports of the panel's frame, can also be seen. The "ball lock" (609), whose purpose is to prevent vertical displacements of the lock system, is also visible. Both vertical lines of locks are linked at their superior parts by a rigid transverse rod (605) (hereinafter called "hanger"). This allows vertical displacement to be regulated through an attached bar (606). This bar has an orifice (607), which serves as the connection to a system that moves all the locks (this will be explained later).

The following elements are also included in this particular version of the support and fastening means of the sheets:

Behind the lock a series of grooves can be seen on surface (140), which is fixed to the panel's frame. These are called "windows" (611). Through these windows, a number of perforated plates (640) penetrate into the lock. These plates have a hole (630) through them which is pierced by the bolt (610). Each sheet has its own perforated plate. There will be as many windows (611) on the surface of the panel (140) as there are sheets between the panels. There will also be as many perforated plates (640) as sheets. This does not necessarily mean that each window will be occupied by its corresponding perforated plate (640), because they might not exist, as will become clear.

Figure 13:
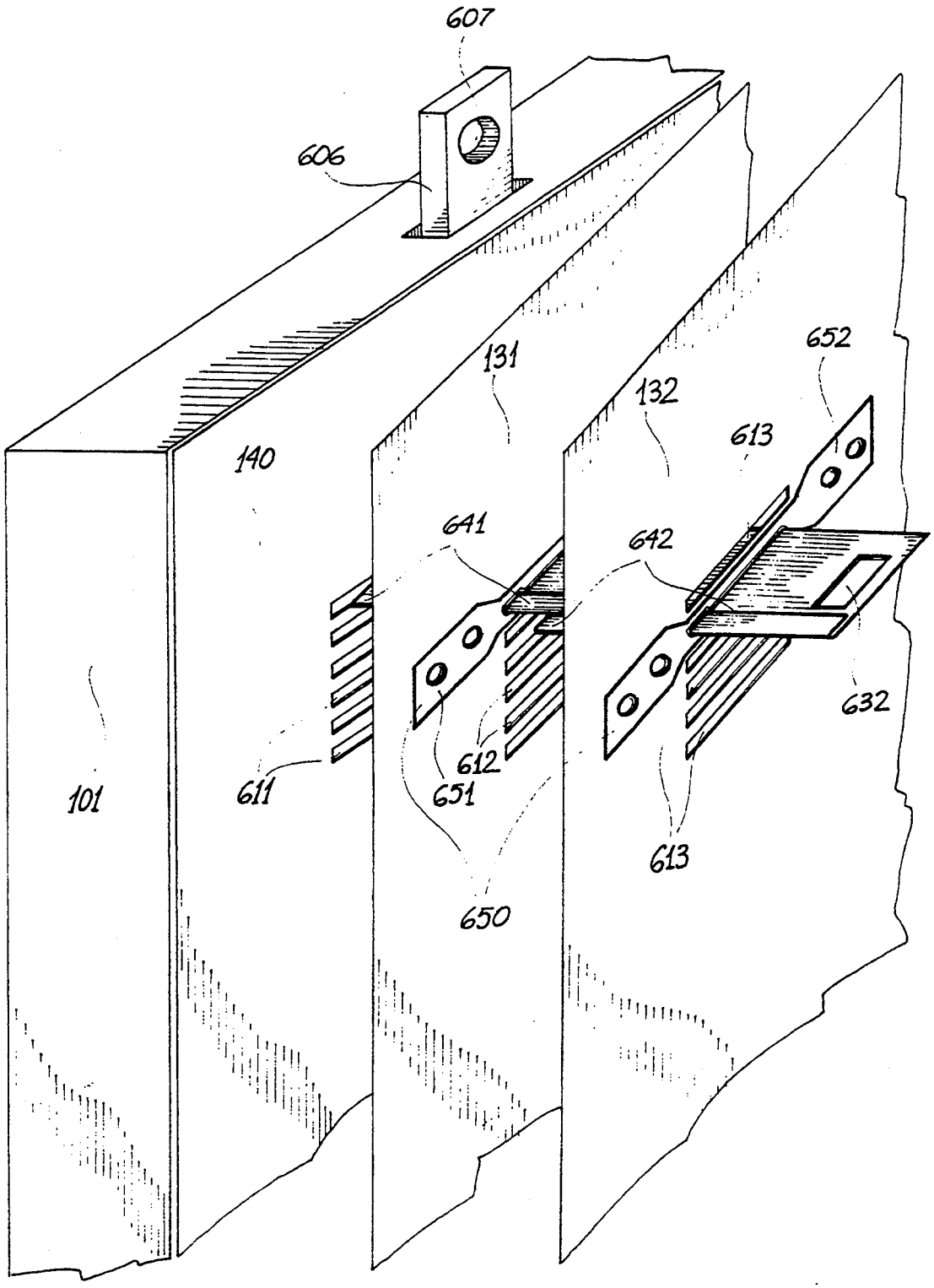
FIG. 13 is a detail perspective view showing part of the support and fastening means for the individual advertising sheets.

FIG. 13 shows the details of the perforated plates (640) that will be installed on each sheet, in order to fix it to the panel. These plates will hereafter be called "fixing languets" (640). The fixing languet (640) is attached to a respective sheet by means of a clinched support (650). For sheet (132), the hole is (632), the fixing languet is (642), and the clinched support is (652).

The fixing languets (640), which could be made of metal or any other resistant and rigid material, are perpendicularly implanted in the plane of each sheet. Each fixing languet (640) extends from its respective sheet on both sides so as to properly penetrate the corresponding panels, whenever they are mutually confronted. For this to be possible, it is necessary that all of the sheets have windows, through which the fixing languets of other sheets can pass (for example, windows (612) on sheet (131)). The sheet (132) also has windows (613) to allow the fixing languets of the other sheets to penetrate it. The holes are ordered vertically and positioned so that the fixing languet of the sheet closest to a panel occupies the upper most superior position. The holes corresponding to the other sheets occupy the remaining positions in consecutive order. In FIG. 13, it can also be seen how the panel bar (606) overlaps its orifice (607).

Figure 14:
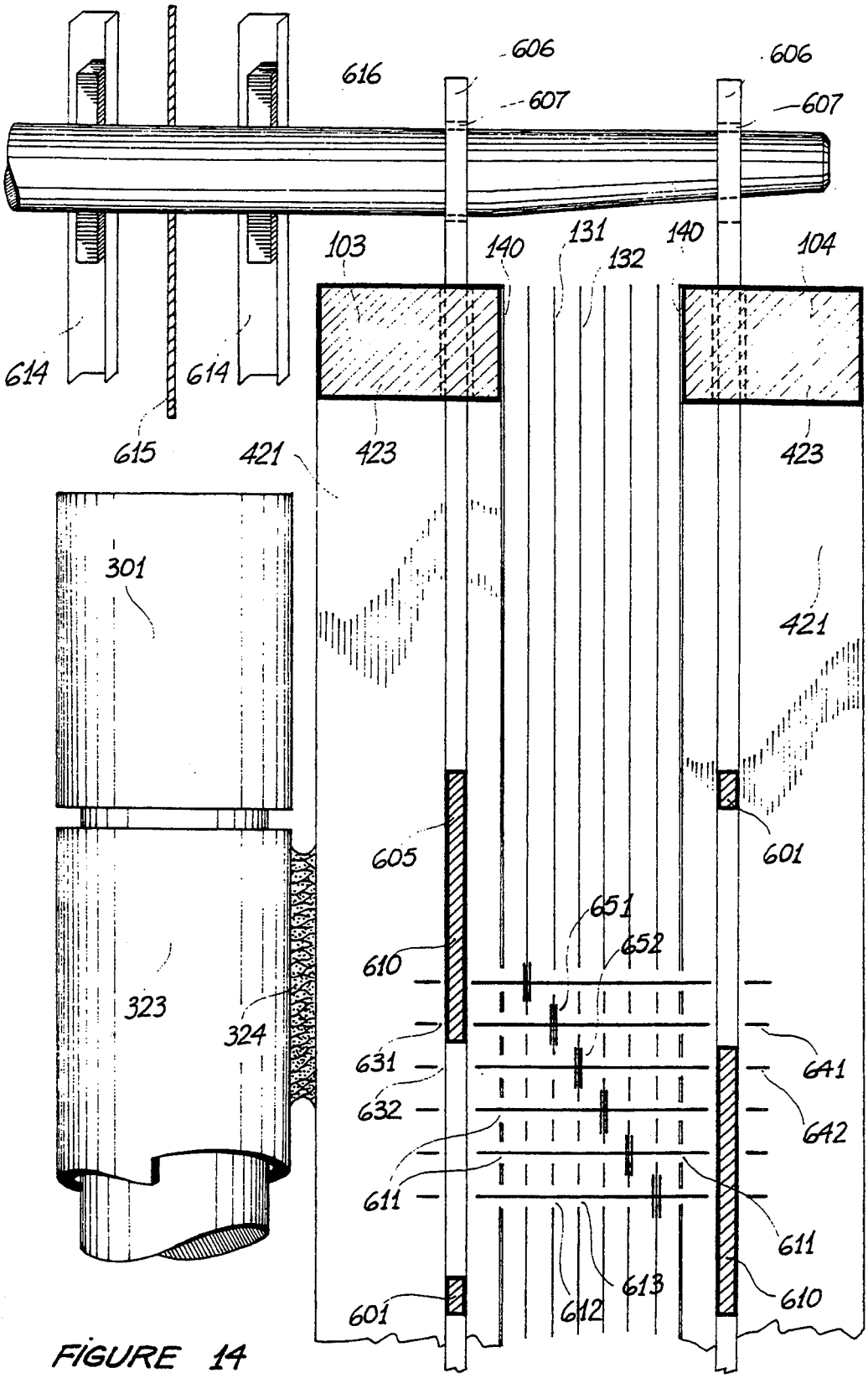
FIG. 14 is a cut-away elevation view of a displacement mechanism for the support and fastening means of the advertising sheets.

FIG. 14 is a cut-away elevation view of the panels (103 and 104) when they are mutually confronted, which means in the second position. In FIG. 14, the following support devices and the sheets attachments used in this particular embodiment of the invention are shown:

The frame structure with the transverse horizontal supports (423) of each panel. A vertical cut shows the orifice through which the vertical bar (606) passes, the vertical supports (421) of each panel, and the surface of the panels (140).

The intermediate sheets, which in this position are pressed in between the two panels, including sheets (131) and (132) which were mentioned above.

The fixing languets of all the sheets, especially fixing languets (641) and (642) corresponding to sheets (131) and (132), respectively, and the supports (651) and (652) which attach the fixing languets to these sheets, and the respective holes (631) and (632). These holes, carried by the corresponding fixing languets, pass through the windows (612, 613, etc.) in the sheets and through the windows (611) in the surfaces of the panels (140).

The front edge of the locks (601) with their respective bolts (610) can also be seen in FIG. 14. They are superior for panel (103) and inferior for (104).

In the plane of the locks are the hangers (605), to which the vertical bars (606) with the holes (607) are attached.

The hinge belonging to the second type articulation (301), similar to first type articulation (302) (the only difference being that there are no sheets attached to second type articulation 301). This hinge is attached to the panel's frame (103) by a ring (323) and a soldered joint (324).

The command stem (613), which is a cylindrical rod that penetrates into the orifices (607) of the vertical bars. It moves vertically along special stem guides (614). It is moved by the stem's cable (615). From the side not seen in FIG. 14, the stem penetrates into the vertical bars corresponding to panels (101) and (102). The stem (613) is symmetrical, with the cable (615) at the stem's midpoint.

The support and attachment system, described with its elements in FIGS. 11 to 14, has two main goals: The first is to firmly support the group of sheets to the panels, so that they form a unit and are not moved by the wind when they are outside. In order to reach this goal, for large signs it will be necessary to support the exposed sheet of each group by means of a number of points per square meter. The second goal is to be able to select the desired image among all the ones that can be composed from all the sheets.

Operation

Taking as a reference the mechanism described in the figures, the operation of the image selection system of the present invention will now be described. The illustrated embodiment of the sign is composed of two known formations, that will alternate as described in the figures. The sign has two extreme static positions (described before as the "first position" and the "second position"), and will move from one to the other with a translation movement. This movement consists mainly of folding in the exposed formation and unfolding the hidden formation. This movement is similar to that of an accordion. The second type articulations (304) and (305), which link both formations, control the motion. Moving these articulations in one direction and then the other moves the sign from one position to the other and vice-versa. These second type articulations roll on straight rails (501 and 502).

The existence of the two formations of panels guarantees the exhibition of at least two different messages (one from each formation), but each formation can show a number of different messages. Thus, the number of messages is independent of the number of formations. The changing of messages takes place within the minimal units, which are composed of a pair of panels linked by a first type articulation (302, 303, 306 and 307). Each pair encloses, between the surfaces of the two panels, multiple sheets (in the example 131 and 132, but generically called 130) that are linked to the first type articulations. This minimal unit, composed of a pair of panels and the sheets between them, operates like a book with covers and pages. When a book is opened on the different pages, different messages are seen. In the same way, when a pair of panels is opened taking different sheets, different messages are seen.

The sheets (130) are plates without any additional structure and so are very unstable. For that reason, it is impossible to change the message by simply moving the sheets leaving the panels in a fixed position in the same plane (e.g., panels 101 and 102). The changes have to take place in the moment that the two panels are mutually confronted with all the sheets pressed between them.

The translation movement (folding of panels), described before, has two basic objectives: first, to produce a visual effect that will attract the attention of the viewer; and second, to carry the formation that is being shown to a new position. This is the position in which the panels of a pair are mutually confronted so that the changing of images can take place.

In the first position, as shown in FIG. 1, the first formation is exposed and the second formation has its pair of panels confronted. Through the folding-in process shown in FIG. 3 (impulsed by the movement towards the center of articulations 304 and 305), the sign passes to the second position shown in FIG. 5. In this position the second formation is exposed, and the first formation has its pair of panels confronted. The sign will stay in this position for a desired period of time. During that time, the process of selecting the sheets to form the next image of the first formation occurs. This operation takes place in the two pairs of panels (101, 102 and 103, 104) that compose this formation. It is done in a coordinated and simultaneous way such that they form a unique image in the four panels that will be visible when the sign goes back to the first position. If the formation has more than two pairs of panels they all will have to perform this process at the same time.

At the desired time the second type articulations (304 and 305) separate, folding in the second formation and displaying the first. During the transformation the sign will look like FIG. 3, but will be moving in the opposite direction. It arrives to the first position (FIG. 1), but the first formation displayed now shows a new image, the product of particular selection of sheets (130).

In this first position we have now a second formation in the appropriate position to change images. The process is similar to the one for the first formation. When the sign returns to the second position of FIG. 5 (when the second formation composed of panels 201, 202, 203, and 204 is exposed again), the second image will be shown.

In this way, the sequence of movement is repeated. The formation is exposed again, but it may show a different image. These images can be chosen and shown in any order desired.

The sheet support and attachment system (described in FIGS. 11, 12, 13, and 14) helps provide the means for image selection. Each sheet has (as described earlier) a number of attachment languets (640), distributed throughout its surface. These languets are adhered perpendicularly to the sheets and extend from both faces. They fix the sheets to each panel at a plurality of locations when a bolt (610) of a lock (601 and 602) passes through them.

Where one sheet has languets (640), all the other sheets have windows (612, 613, etc.). When all the sheets are in contact, forming a packet, a group of languets (640) will be seen extending from both faces. Each group will be formed by as many aligned languets as sheets in the packet.

When the panels press the sheets, each group of languets (640) penetrate each panel (one on each side) through the windows (611) in the surface (140). The packet remains within the frame of rods that form the lock (601 or 602 shown in FIG. 14). For that reason each lock (601 or 602 shown in FIG. 11) corresponds to a group of languets.

In the position shown in FIG. 5, when the panels press all the sheets together and all the languets are aligned, the holes (630) will be vertically aligned, allowing the entry of bolt (610). The lock moves vertically over the support (421) of the panel's frame. This movement is synchronized with the movement of all the other locks (601 or 602). The locks are linked by means of the vertical rods (603 and 604), which are in turn attached to the frame by means of the guides (608). The locks are moved by the hanger (605), which links both vertical rods through the bar (606). The bar crosses through the transverse support of the frame (423).

Suppose that in the first position (FIG. 1), all the sheets of the panel pairs (101) and (102) lay over panel (102), and the sheets (103) and (104) lay over the panel (104). The image shown by the sign is displayed on the visible face of the last sheets laid on each panel, and over the surfaces (140) of the panels (101 and 103).

This is selection N.1, in which panels (101) and (103) are free (no sheets are attached to them), and so their windows (611) are free of fixing languets (640). Panels (102) and (104) have all the sheets attached to them. This means that the windows (611) are all filled with the languets (640) of each sheet (130). Because the sheets should be attached to the panels, the languets, used for that purpose and distributed all along the surface, have to be locked on the panels in order to retain the sheets. This is the function of the bolt (610), which in the case of the panels (102) and (104), retains the languets. It does so by penetrating all the holes (630).

When the sign passes to the second position, both pair of panels of the first formation will be mutually confronted (FIG. 5), pressing the sheets (130) together. All the free languets (640) of the sheets will penetrate through the windows (611) of the panels (101 and 103) within the locks (601 and 602) of the panels. In that moment, the position will be as in FIG. 14 and still in the state of selection N.1. The locks of panels (102) and (104), have their bolts penetrating all the languets (640) through the holes. The locks of the panels (101 and 103), are displaced so that their bolts do not pierce any hole. If the pair would open again, the image would be the same. The sheets are attached as before.

If, instead, all the locks of both panels are moved vertically down, advancing one position in a synchronized way, all the bolts of panels (102) and (104) leave the holes of the first languets. These languets occupy the superior places of the so called "groups of languets". At the same time in panels (101) and (103), the bolts enter the holes of the first languets.

This means, with this advancement of one position, the first sheets of the packets become independent of the panels (102 and 104), and are fixed to the panels (101 and 103). The second sheets of the packets stay fixed to panels (102) and (104) because the bolts of those locks, advancing only one point, still penetrate the holes belonging to the second sheets.

If at this time the sign moves back to the first position, we will see the first formation showing a different image, because different sheets are exposed which show selection N.2.

In order to accomplish this changing of images, the bolts in the opposing panels must function differently. The bolts in panels (102) and (104) are "inferior" bolts.

The bolts in panels (101) and (103) are "superior" bolts (FIG. 12). When the inferior bolts move in one direction (forward or backward), the superior bolts move in the opposite direction. The locks do not have to move in a progressive sequence. Two positions can be advanced at one time, either forward or backward.

These movements are directed by the command stem (616), which is a cylindrical horizontal bar, moved vertically by a cable (615). In the first formation, this stem is symmetrically positioned above articulation (301). The motor cable (615) is located in the plane that passes through the articulation's axis.

This stem is attached to the vertical bar (606). This bar moves the "hangers" (605) that link both series of vertical locks. This vertical bar has a hole (607), through which the command stem penetrates.

As explained before, the changing of sheets on all the panels is done simultaneously. This means the stem is linked to the bars of the four panels at the same time. This is done when the sign changes positions. The position of the stem and the bars are such that when the second position is formed, the vertical bars of the panels (101 and 102) fit on the left half of the stem. At the same time, the bars of panels (103) and (104) fit on the right side, with the stem penetrating through the holes (607) of each bar. In this second position (FIG. 5), the four vertical bars are linked to the command stem. The motor cable can pull the stem up (or push it down). In either case, it moves the lock systems of all four panels, pushing the locks.

Each movement of this type leads to a change in the sheet selected. The movements can displace the lock bolts several positions at the same time and in either direction. This is possible because the cable (615) is moved by a "servo" engine, controlled by either a mechanical programmer or an electronic processor.

After the change has taken place, the sign stays in the second position for a pre-determined length of time. Then, when it starts the movement to go back to the first position, the stem is moved out of the vertical bars. The lock systems of the panels in the first formation remain in a fixed (unchanged) position during the translation, exposition, and return to the second position. When in the second position, the stem and the holes meet again. Vertical "ball locks" (609), that lock the vertical rods (603 and 604) to the frame's supports, are used to keep the lock system fixed while the panels move.

In order to change the images of the second formation (whose panels are confronted during the first formation), two command half-stems are necessary. There is one half-stem for each pair of panels (210, 202 and 203, 204). Two motor cables and two "servo" engines operate the stems and use the same programmer.

This functioning system will operate in the same way for any kind of sign, but will have different components according to the size of the sign. Medium size-outdoors signs will have a smaller number of locks per area unit. In smaller size or indoor signs, the lock systems are placed on the back side of the panel. For these last cases, there is one languet on each sheet which overlaps the border of the panel (above, below or on both sides).

These languets are positioned in a way such that with a displacing lock, the desired languet can be attached to the desired panel, thereby choosing the different selections. The displacing locks are fixed to each panel's structure on either the superior or the inferior border. They are moved by means of elements that are similar to the command stems, but displace in a horizontal fashion (with its necessary motor cable, the "servo" engines, and the programmers), and captures the desired sheet.

Motor System Description

In the following paragraphs, some basic characteristics of the motor system of the sign are described. The explanation is based on the fixed frame sign within which the panels move (same as in the example). This invention, though, also includes frameless signs with only one formation. In this case, the motor system has to be adapted accordingly.

Whatever the configuration of the sign is, from one pair to several formations, the upper and lower guide devices as well as linking features will always be necessary for the sign to function. These linking features are, essentially, rolling or displacement devices. They may be fixed to the first or second articulations or positioned in the middle of the upper border of a panel's frame. The upper and lower linking features are always vertically aligned. The rigidity of the panels forces this vertical alignment, no matter what instant in the movement of the sign.

In the example, the changing of the position (from the first to the second) is achieved through the movement of the second type articulations (304 and 305). This movement can be impulsed by forces applied only to the lower extremes of the articulations. A tense chain, along with spoked pulleys (one at each second articulation, which means one for each half of the sign), is used to move the panels. A master chain, connected to a motor, moves the entire system.

At the completion of the movement to the second position, the second type articulations activate a switch that stops the engine and the movement. When the sign changes back to the first position, the chains (and the engine) move in the opposite direction. The initiating and inverting of the engine are controlled by the same mechanical programmer or electronic processor used to select the sheets to be displayed.

The complete sequence of static states and movements of the sign are:

1—First position, first formation in selection N.1
2—Exposition time—first formation
3—Starting of the engine in direction A (see FIG. 3)
4—Stop
5—Second position, second formation in selection N.1— First formation folded in with panels confronted Command stem (616) linked with bars (607) of panels (101, 102, 103, and 104)
6—Change the image in the first formation, selection N.2—(the stem moves pulling the whole lock system, which changes . . . the sheet selection)
7—Exposition time—second formation
8—Starting of the engine in direction B (see FIG. 3)
9—Stop
10—First position, first formation in selection N.2— Second formation folded in with panels confronted Command stem (616) linked with bars (607) of panels (201, 202, 203, and 204)
11—Change the image in the second formation, selection N.2
12—Exposition time—first formation
13—Starting of the engine in direction A (see FIG. 3)
14—Stop
15—Second position, second formation in selection N.2— First formation folded in with panels confronted Command stem (616) linked with bars (607) of panels (101, 102, 103, and 104)

16—Change the image in the first formation, selection N.3—

17—Exposition time—second formation

18—Starting of the engine in direction B (see FIG. 3)—

19—Stop

20—First position, first formation in selection N.3

This cycle continues until all the sheets of each formation are shown (exposition time could be different for each sheet). The cycle is then repeated starting with step 1. The displaying of images can be in any sequence desired (for instance a special sequence could be displayed at particular times of the day). All this can be accomplished through the movement of the command stem (616) in steps 6, 11, 16, etc.

The illustrated embodiment and its operation were chosen and described in order to best explain the principles of the invention and its practical application to thereby enable others skilled in the art to best utilize the invention and various embodiments and with various modifications as are suited to the particular use contemplated. It is intended that the scope of the invention only be limited by the claims appended hereto.

I claim:

1. A multiple-panel display device for assembling and displaying selected messages, comprising:

a first pair of generally rectangular panels, each panel having a display surface for displaying a message;

a first articulation connecting said first pair of panels to each other;

a supporting frame with a guide means for guiding said first pair of panels between a first position in which said display surfaces of said first pair of panels are generally coplanar, and a second position in which said display surfaces are mutually confronted;

wherein a plurality of sheets having images formed thereon are pivotally attached to said first articulation and are angularly displaceable with respect to said panels about said first articulation, and fastening means on each panel for selectively fastening a selected number of said plurality of sheets against the display surface of a respective one of said panels, whereby the image formed on at least one selected sheet forms a portion of a displayed message when said first pair of panels are in their first position.

2. A display device according to claim 1, wherein said fastening means comprises at least one lock assembly mounted to each panel, said lock assembly having a selectively movable bolt, and at least one languet fixed to and extending perpendicularly from each sheet, said languets each having a hole for receiving said movable bolt, whereby selected sheets are fastened to a respective panel when said movable bolt engages the respective languets of said selected sheets.

3. A display device according to claim 2, wherein said sheets and said panels each have at least one series of windows formed therein, said languets each passing through a respective window of one of said series of windows to communicate with said at least one locking assembly.

4. A display device according to claim 3, wherein said at least one locking assembly comprises a plurality of locking assemblies, said at least one series of windows comprises a plurality of series of windows in each panel and sheet, and said at least one languet comprises a plurality of languets fastened to each sheet, said plurality of languets of each sheet corresponding in number to said plurality of locking assemblies.

5. A display device according to claim 4, wherein said plurality of locking assemblies are operatively linked to each other for simultaneous movement of their respective movable bolts.

6. A display device according to claim 1, further comprising:

a second pair of generally rectangular panels, each panel of said second pair having a display surface for displaying a message;

a second articulation connecting said second pair of panels to each other;

said guide means guiding said second pair of panels between a first position in which said display surfaces of said second pair of panels are generally coplanar, and a second position in which said display surfaces of the second pair of panels are mutually confronted; and a second plurality of sheets having images formed thereon linked to said second articulation and angularly displaceable about said second articulation, and fastening means on each panel of said second pair of panels for selectively fastening a selected number of said second plurality of sheets against the display surface of a respective one of said second pair of panels, whereby the image formed on at least one selected sheet from said second plurality of sheets forms a portion of a displayed message when said second pair of panels are in their first position.

7. A display device according to claim 6, wherein when said first pair of panels are positioned in their first position with their respective display surfaces in the same plane, said second pair of panels are positioned in their second position with their display surfaces mutually confronted, and when said first pair of panels are positioned in their second position with their respective display surfaces mutually confronted, said second pair of panels are positioned in their first position with their display surfaces in the same plane.

8. A display device according to claim 7, wherein said fastening means on each panel comprises at least one lock assembly mounted to each panel, said lock assembly having a selectively movable bolt, and at least one languet fixed to and extending perpendicularly from each sheet, said languets each having a hole for receiving said movable bolt, whereby selected sheets are fastened to a respective panel when said movable bolt engages the respective languets of said selected sheets.

9. A display device according to claim 8, wherein said sheets and said panels each have at least one series of windows formed therein, said languets each passing through a respective window of one of said series of windows to communicate with said at least one locking assembly.

10. A display device according to claim 9, wherein said at least one locking assembly comprises a plurality of locking assemblies mounted to each panel, said at least one series of windows comprises a plurality of series of windows in each panel and sheet, and said at least one languet comprises a plurality of languets fastened to each sheet, said plurality of languets of each sheet corresponding in number to said plurality of locking assemblies of each panel.

11. A display device according to claim 10, wherein said plurality of locking assemblies of each panel are operatively linked to each other for simultaneous movement of their respective movable bolts.

12. A multiple-panel display device for assembling and displaying selected messages, comprising:

at least one display panel assembly, said display panel assembly comprising a pair of panels, a plurality of sheets having images formed thereon, an articulation about which said panels and sheets are hingedly mounted, and a fastening means on each panel for selectively fastening said sheets against a display surface of a selected one of said panels, said sheets being angularly displaceable about said articulation with respect to said panels; and a supporting frame with a guide means for guiding said panels of said at least one display panel assembly between a first position in which the display surfaces of the panels are generally coplanar, and a second position in which the display surfaces are mutually confronted;

whereby the images formed on said sheets are selectively displayed when said at least one display panel assembly is in its first position.

13. A display device according to claim 12, wherein said at least one display panel assembly comprises a plurality of display panel assemblies operatively connected to one another for synchronized movement.

14. A display device according to claim 13, wherein said plurality of display panel assemblies comprise a first pair of panel assemblies and a second pair of panel assemblies, said first pair of panel assemblies being positioned in their first positions with their respective display surfaces in the same plane when said second pair of panel assemblies are positioned in their second positions with their display surfaces mutually confronted, and said first pair of panel assemblies being positioned in their second positions with their respective display surfaces mutually confronted when said second pair of panel assemblies are positioned in their first positions with their display surfaces in the same plane.

15. A display device according to claim 14, further comprising an articulation connecting said first pair of panel assemblies together, and an articulation connecting said second pair of panel assemblies on respective sides of said first pair of panel assemblies.

16. A display device according to claim 15, wherein said fastening means of each display panel assembly are selectively adjustable when said panel assembly is in its second position so that a different image will be displayed when said panel assembly is again moved to its first position.

* * * * *